US012178237B2

(12) United States Patent
Mua et al.

(10) Patent No.: US 12,178,237 B2
(45) **Date of Patent: *Dec. 31, 2024**

(54) PROTEIN-ENRICHED TOBACCO COMPOSITION

(71) Applicant: R.J. REYNOLDS TOBACCO COMPANY, Winston-Salem, NC (US)

(72) Inventors: John-Paul Mua, Advance, NC (US); Gong Chen, Clemmons, NC (US); Thaddeus Jude Jackson, Summerfield, NC (US); Anthony Richard Gerardi, Winston-Salem, NC (US); Kyle Ford, Germanton, NC (US); Barry Smith Fagg, Winston-Salem, NC (US); Melissa Ann Clark, Mocksville, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/110,774

(22) Filed: Feb. 16, 2023

(65) Prior Publication Data

US 2023/0189872 A1 Jun. 22, 2023

Related U.S. Application Data

(63) Continuation of application No. 14/965,080, filed on Dec. 10, 2015, now Pat. No. 11,612,183.

(51) Int. Cl.

| | |
|---|---|
| ***A24B 13/00*** | (2006.01) |
| ***A24B 3/14*** | (2006.01) |
| ***A24B 15/10*** | (2006.01) |
| ***A24B 15/24*** | (2006.01) |
| ***A24B 15/32*** | (2006.01) |

(52) U.S. Cl.

CPC ..... *A24B 15/24* (2013.01); *A24B 3/14* (2013.01); *A24B 13/00* (2013.01); *A24B 15/10* (2013.01); *A24B 15/32* (2013.01)

(58) Field of Classification Search

None

See application file for complete search history.

(56) References Cited

U.S. PATENT DOCUMENTS

| | | | |
|---|---|---|---|
| 1,376,586 | A | 5/1921 | Schwartz |
| 3,696,917 | A | 10/1972 | Levi |
| 3,959,246 | A | 5/1976 | Bickoff et al. |
| 4,244,381 | A | 1/1981 | Lendvay |
| 4,268,632 | A | 5/1981 | Wildman et al. |
| 4,340,676 | A | 7/1982 | Bourque |
| 4,400,471 | A | 8/1983 | Johal |
| 4,513,756 | A | 4/1985 | Pittman et al. |
| 4,528,993 | A | 7/1985 | Sensabaugh, Jr. et al. |
| 4,588,691 | A | 5/1986 | Johal |
| 4,624,269 | A | 11/1986 | Story et al. |
| 4,716,120 | A | 12/1987 | Tsay et al. |
| 4,941,484 | A | 7/1990 | Clapp et al. |
| 4,987,907 | A | 1/1991 | Townsend |
| 4,991,599 | A | 2/1991 | Tibbetts |
| 5,092,352 | A | 3/1992 | Sprinkle, III et al. |
| 5,387,416 | A | 2/1995 | White et al. |
| 5,662,920 | A | 9/1997 | Santus |
| 6,033,895 | A | 3/2000 | Garger et al. |
| 6,668,839 | B2 | 12/2003 | Williams |
| 6,834,654 | B2 | 12/2004 | Williams |
| 6,953,040 | B2 | 10/2005 | Atchley et al. |
| 7,032,601 | B2 | 4/2006 | Atchley et al. |
| 7,048,211 | B2 | 5/2006 | Bratcher et al. |
| 7,694,686 | B2 | 4/2010 | Atchley et al. |
| 2002/0197688 | A1 | 12/2002 | Pandolfino |
| 2004/0020503 | A1 | 2/2004 | Williams |
| 2005/0115580 | A1 | 6/2005 | Quinter et al. |
| 2005/0147670 | A1 | 7/2005 | Hsu et al. |
| 2005/0241658 | A1 | 11/2005 | Pera |
| 2005/0244521 | A1 | 11/2005 | Strickland et al. |
| 2006/0073333 | A1 | 4/2006 | Anderson |
| 2006/0191548 | A1 | 8/2006 | Strickland et al. |
| 2007/0062549 | A1 | 3/2007 | Horton, Jr. et al. |
| 2007/0137663 | A1 | 6/2007 | Taylor et al. |
| 2007/0186941 | A1 | 8/2007 | Holton, Jr. et al. |
| 2007/0186942 | A1 | 8/2007 | Strickland et al. |

(Continued)

FOREIGN PATENT DOCUMENTS

| | | |
|---|---|---|
| CA | 1 166 114 | 4/1984 |
| EP | 1 623 634 | 2/2006 |
| JP | 1162008 | 10/1997 |
| WO | WO 2004/095959 | 11/2004 |
| WO | WO 2005/016036 | 2/2005 |
| WO | WO 2005/041699 | 5/2005 |

(Continued)

OTHER PUBLICATIONS

Hauck et al., "The Manufacture of Allergenic Extracts in North America," *Clinical Review in Allergy and Immunology*, 2001, pp. 93-110, vol. 21.

Krishnan et al., "A Rapid Method for Depletion of Rubisco From Soybean (Glycine Max) Leaf for Proteomic Analysis of Lower Abundance Proteins," *Phytochemistry*, 2009, pp. 1958-1964, vol. 70.

(Continued)

*Primary Examiner* — Katherine A Will

(74) *Attorney, Agent, or Firm* — Womble Bond Dickinson (US) LLP

(57) ABSTRACT

The present disclosure provides protein-enriched, tobacco-containing products, suitable for use as oral formulations. Products of the present disclosure typically include at least one tobacco material (e.g., a particulate tobacco material or a tobacco-derived extract), at least one protein-enriched material (e.g., a tobacco-derived protein-enriched material), and at least one sugar alcohol.

23 Claims, No Drawings

(56) References Cited

U.S. PATENT DOCUMENTS

| | | | | |
|---|---|---|---|---|
| 2007/0193596 | A1 | 8/2007 | Mori et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0173317 | A1 | 7/2008 | Robinson et al. | |
| 2008/0196730 | A1 | 8/2008 | Engstrom et al. | |
| 2008/0209586 | A1 | 8/2008 | Neilsen et al. | |
| 2008/0305216 | A1 | 12/2008 | Crawford et al. | |
| 2009/0025738 | A1 | 1/2009 | Mua et al. | |
| 2009/0025739 | A1 | 1/2009 | Brinkley et al. | |
| 2009/0065013 | A1 | 3/2009 | Essen et al. | |
| 2009/0293889 | A1 | 12/2009 | Kumar et al. | |
| 2010/0018540 | A1 | 1/2010 | Doolittle et al. | |
| 2010/0018541 | A1 | 1/2010 | Gerardi et al. | |
| 2010/0093054 | A1 | 4/2010 | Lo et al. | |
| 2010/0291245 | A1 | 11/2010 | Gao et al. | |
| 2011/0129517 | A1* | 6/2011 | Rudolph ..... | A61K 47/26 424/440 |
| 2011/0139164 | A1 | 6/2011 | Mua et al. | |
| 2011/0174323 | A1 | 7/2011 | Coleman, III et al. | |
| 2011/0247640 | A1 | 10/2011 | Beeson et al. | |
| 2011/0259353 | A1 | 10/2011 | Coleman, III et al. | |
| 2012/0037175 | A1 | 2/2012 | Cantrell et al. | |
| 2012/0055494 | A1 | 3/2012 | Hunt et al. | |
| 2012/0103353 | A1 | 5/2012 | Sebastian et al. | |
| 2012/0125354 | A1 | 5/2012 | Byrd et al. | |
| 2012/0138073 | A1 | 6/2012 | Cantrell et al. | |
| 2012/0138074 | A1 | 6/2012 | Cantrell et al. | |
| 2012/0141648 | A1 | 6/2012 | Morton et al. | |
| 2012/0152265 | A1 | 6/2012 | Dube et al. | |
| 2012/0192880 | A1 | 8/2012 | Dube et al. | |
| 2012/0192882 | A1 | 8/2012 | Dube et al. | |
| 2012/0211016 | A1 | 8/2012 | Byrd, Jr. et al. | |
| 2012/0272976 | A1 | 11/2012 | Byrd et al. | |
| 2013/0074855 | A1 | 3/2013 | Holton, Jr. | |
| 2013/0118512 | A1 | 5/2013 | Jackson et al. | |
| 2013/0209540 | A1 | 8/2013 | Duggins et al. | |
| 2013/0263870 | A1 | 10/2013 | Cantrell et al. | |
| 2014/0271952 | A1 | 9/2014 | Mua et al. | |
| 2014/0343254 | A1 | 11/2014 | Gerardi et al. | |

FOREIGN PATENT DOCUMENTS

| | | |
|---|---|---|
| WO | WO 2005/063060 | 7/2005 |
| WO | WO 2008/143914 | 11/2008 |
| WO | WO 2010/132444 | 11/2010 |

OTHER PUBLICATIONS

Siceloff, "A Revolutionary Upheaval? Tobacco for Protein" *N.C. Insight*, Jun. 1981, pp. 28-32. http://www.nccppr.org/drupal/content/insightarticle/918/tobacco-for-protein.

* cited by examiner

PROTEIN-ENRICHED TOBACCO COMPOSITION

CROSS-REFERENCE TO RELATED APPLICATIONS

This application is a continuation of U.S. application Ser. No. 14/965,080 filed on Dec. 10, 2015, which is incorporated herein by reference in its entirety.

FIELD OF THE INVENTION

The present invention relates to products made or derived from tobacco, or that otherwise incorporate tobacco or components of tobacco, and are intended for human consumption. Of particular interest are products containing one or more ingredients or components obtained or derived from plants or portions of plants from the *Nicotiana* species.

BACKGROUND OF THE INVENTION

Cigarettes, cigars, and pipes are popular smoking articles that employ tobacco in various forms. Such smoking articles are employed by heating or burning tobacco to generate aerosol (e.g., smoke) that may be inhaled by the smoker. Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain cigarettes incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. A cigarette is employed by a smoker by lighting one end thereof and burning the tobacco rod. The smoker then receives mainstream smoke into his/her mouth by drawing on the opposite end (e.g., the filter end) of the cigarette.

Tobacco also may be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and 7,694,686 to Atchley et al.; US Pat. Pub. Nos. 2004/0020503 to Williams; 2005/0115580 to Quinter et al.; 2005/0244521 to Strickland et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0025738 to Mua et al.; 2009/0025739 to Brinkley et al.; 2009/0065013 to Essen et al.; 2009/0293889 to Kumar et al.; 2010/0018540 to Doolittle et al; 2010/0018541 to Gerardi et al.; 2010/0291245 to Gao et al; 2011/0139164 to Mua et al.; 2011/0174323 to Coleman, III et al.; 2011/0247640 to Beeson et al.; 2011/0259353 to Coleman, III et al.; 2012/0037175 to Cantrell et al.; 2012/0055494 to Hunt et al.; 2012/0103353 to Sebastian et al.; 2012/0125354 to Byrd et al.; 2012/0138073 to Cantrell et al.; 2012/0138074 to Cantrell et al; and 2013/0074855 to Holton; PCT WO 04/095959 to Arnarp et al.; PCT WO 05/063060 to Atchley et al.; PCT WO 05/004480 to Engstrom; PCT WO 05/016036 to Bjorkholm; PCT WO 05/041699 to Quinter et al., and PCT WO 10/132444 to Atchley; each of which is incorporated herein by reference.

One type of smokeless tobacco product is referred to as "snuff." Representative types of moist snuff products, commonly referred to as "snus," have been manufactured in Europe, particularly in Sweden, by or through companies such as Swedish Match AB, Fiedler & Lundgren AB, Gustavus AB, Skandinavisk Tobakskompagni A/S, and Rocker Production AB. Snus products available in the U.S.A. have been marketed under the tradenames Camel Snus Frost, Camel Snus Original and Camel Snus Spice by R. J. Reynolds Tobacco Company. See also, for example, Bryzgalov et al., 1N1800 Life Cycle Assessment, Comparative Life Cycle Assessment of General Loose and Portion Snus (2005). In addition, certain quality standards associated with snus manufacture have been assembled as a so-called GothiaTek standard. Representative smokeless tobacco products also have been marketed under the tradenames Oliver Twist by House of Oliver Twist A/S; Copenhagen moist tobacco, Copenhagen pouches, Skoal Bandits, Skoal Pouches, SkoalDry, Rooster, Red Seal long cut, Husky, and Revel Mint Tobacco Packs by U.S. Smokeless Tobacco Co.; Marlboro Snus and "taboka" by Philip Morris USA; Levi Garrett, Peachy, Taylor's Pride, Kodiak, Hawken Wintergreen, Grizzly, Dental, Kentucky King, and Mammoth Cave by American Snuff Company, LLC; Camel Snus, Camel Orbs, Camel Sticks, and Camel Strips by R. J. Reynolds Tobacco Company. Other exemplary smokeless tobacco products that have been marketed include those referred to as Kayak moist snuff and Chattanooga Chew chewing tobacco by Swisher International, Inc.; and Redman chewing tobacco by Pinkerton Tobacco Co. LP.

It would be desirable to provide an enjoyable form of a tobacco product, such as a smokeless tobacco product, and to provide processes for preparing tobacco-containing compositions suitable for use in smokeless tobacco products.

SUMMARY OF THE INVENTION

The present disclosure relates to a protein-enriched smokeless tobacco product configured for insertion into the mouth of a user and processes for preparing a protein-enriched smokeless tobacco composition suitable for use in a smokeless tobacco product. The composition of the protein-enriched smokeless tobacco products disclosed herein can vary, giving products having a range of textures and other physical properties.

In one aspect, the invention provides a protein-enriched smokeless tobacco product comprising: a tobacco material; a protein-enriched, tobacco-derived material in an amount of at least about 2 percent by weight; and one or more sugar alcohols in an amount of at least about 10 percent by weight, based on the total weight of the smokeless tobacco product, wherein the protein-enriched tobacco-derived material comprises at least about 60% tobacco-derived protein by dry weight. Exemplary tobacco-derived materials can comprise higher amounts of tobacco-derived protein, e.g., at least about 70%, at least about 80%, at least about 90%, or at least about 95% by weight in certain embodiments.

The protein-enriched, tobacco-derived material can, in some embodiments, comprise RuBisCO, F2 proteins, or a combination thereof. In some embodiments, the protein-enriched, tobacco-derived material contains RuBisCO as the primary protein component, e.g., wherein the protein of the protein-enriched, tobacco-derived material comprises RuBisCO in an amount of at least about 50%, at least about 75%, at least about 90%, at least about 95%, or at least about 98% by weight. In other embodiments, the protein-enriched, tobacco-derived material contains F2 proteins as the primary protein component, e.g., wherein the protein of the protein-enriched, tobacco-derived material comprises F2 proteins in an amount of at least about 50%, at least about 75%, at least about 90%, at least about 95%, or at least about 98% by weight.

The tobacco material can vary. In some embodiments, the tobacco material can comprise a particulate tobacco material. For example, the particulate tobacco material can, in certain embodiments, comprise a mixture of flue-cured and sun-cured tobacco. In some embodiments, the tobacco material can comprise a tobacco extract (e.g., an aqueous tobacco extract). In some embodiments, the tobacco material can comprise a particulate tobacco material and a tobacco extract. In some embodiments, the tobacco material comprises a heat-treated tobacco material that has been treated prior to incorporation within the smokeless tobacco product by heating the tobacco material in an aqueous solution comprising L-lysine.

The type of tobacco material can, in some embodiments, affect the amount of tobacco material incorporated within a given tobacco composition or product disclosed herein. For example, where the tobacco material comprises a particulate tobacco material, the particulate tobacco material can be incorporated within the product in an amount of at least about 10%, at least about 5%, at least about 20%, at least about 25%, or between about 10% and about 50%, between about 15% and about 40%, or between about 20 and about 40% by dry weight. Typical amounts of tobacco extract can be somewhat less. For example, exemplary tobacco extract-containing products can incorporate extract in an amount of at least about 1% by dry weight, at least about 2% by dry weight, at least about 3% by dry weight (e.g., between about 1% and about 10% by dry weight, between about 2% and about 10% by dry weight, or between about 2% and about 5% by dry weight).

Suitable sugar alcohols for providing a smokeless tobacco product in accordance with the present disclosure include, but are not limited to, erythritol, arabitol, ribitol, isomalt, maltitol, dulcitol, iditol, mannitol, xylitol, lactitol, sorbitol, and combinations thereof. Particularly advantageous sugar alcohols include sorbitol, maltitol, xylitol, or a mixture thereof. Sugar alcohols can be provided in an amount of from about 10 percent to about 50 percent by dry weight or about 10 percent to about 30 percent by dry weight.

In some embodiments, a natural gum binder (e.g., including, but not limited to, gum arabic, xanthan gum, guar gum, ghatti gum, gum tragacanth, karaya gum, locust bean gum, gellan gum, and combinations thereof) can be included in the compositions disclosed herein. In some embodiments, a non-natural gum binder (e.g., including, but not limited to, pregelatinized corn starch) can be included in the compositions, alone, or in combination with one or more natural gum binders. In certain embodiments, the non-natural gum binder is present in an amount of between about 2 percent and about 10 percent by dry weight or between about 5 percent and about 20 percent by dry weight. In some embodiments, a non-gum binder can be included in the compositions. Non-gum binders can be employed, for example, in amounts of between about 5 percent and about 20 percent by dry weight. One exemplary non-gum binder is pregelatinized rice starch.

In certain embodiments, the compositions disclosed herein can comprise one or more fillers (including, but not limited to, a polysaccharide filler, a starch filler, or a combination thereof). Certain specific fillers include, but are not limited to, rice flour, maltodextrin, calcium carbonate, and combinations thereof. Exemplary amounts of such fillers to be included in the compositions range from about 5 percent to about 20 percent by dry weight. Other additives can optionally be incorporated within the compositions disclosed herein, such as additives selected from the group consisting of flavorants, sweeteners, binders, emulsifiers, disintegration aids, humectants, buffering agents, salts, and mixtures thereof. Certain specific additives include, but are not limited to, glycerin and/or one or more sweeteners.

In another embodiment, a smokeless tobacco composition as referenced generally above is provided, comprising: at least about 20 dry weight percent of the tobacco material, wherein the tobacco material comprises particulate tobacco; and at least about 2 dry weight percent of the protein-enriched, tobacco-derived material, wherein the protein comprises at least about 80 percent by weight RuBisCO. A further composition as referenced generally above comprises at least about 20 dry weight percent of the tobacco material, wherein the tobacco material comprises particulate tobacco; and at least about 2 dry weight percent of the protein-enriched, tobacco-derived material, wherein the protein comprises at least about 80 dry weight percent RuBisCO; at least about 2 dry weight percent of a natural gum binder; and at least about 10 dry weight percent of a binder other than a natural gum binder. Another composition as referenced generally above comprises at least about 20 dry weight percent of the tobacco material, wherein the tobacco material comprises particulate tobacco; at least about 2 dry weight percent of the protein-enriched, tobacco-derived material, wherein the protein comprises at least about 80% by weight RuBisCO; and between about 5 percent and about 20 percent by dry weight of a filler, wherein the filler comprises a combination of a polysaccharide filler and a starch filler. A still further composition comprises at least about 20 dry weight percent of the tobacco material, wherein the tobacco material comprises particulate tobacco; at least about 2 dry weight percent of the protein-enriched, tobacco derived material, wherein the protein comprises at least about 80% by weight RuBisCO; between about 5 and about 20 percent by dry weight of a filler, wherein the filler comprises a combination of a polysaccharide filler and a starch filler; at least about 2 dry weight percent of a natural gum binder; and at least about 10 dry weight percent of a binder other than a natural gum binder.

In another aspect of the invention is provided a method of preparing a protein-enriched smokeless tobacco product, comprising: combining a dry mixture comprising a tobacco material, a protein-enriched, tobacco-derived material, and one or more sugar alcohols in an amount of at least about 10 percent by dry weight, wherein the protein-enriched, tobacco-derived material comprises at least about 60 percent tobacco-derived protein by dry weight, with a wet mixture comprising salt and flavorants; and extruding the combined mixture to give a protein-enriched smokeless tobacco product comprising the protein-enriched, tobacco-derived material in an amount of at least about 2 percent by dry weight and comprising the one or more sugar alcohols in an amount of at least about 10 percent by dry weight. In some embodiments, the protein-enriched smokeless tobacco product is in the form of extruded rods.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The present invention provides tobacco-containing products, suitable for oral use. Certain products of the present disclosure typically include at least one tobacco material (e.g., a particulate tobacco material or a tobacco-derived extract), at least one protein-enriched material (e.g., derived from tobacco), and at least one sugar alcohol. Other products of the disclosure include at least one nicotinic compound, at least one protein-enriched material (e.g., derived from tobacco), and at least one sugar alcohol.

The products described herein are generally dissolvable oral products. As used herein, the terms "dissolve," "dissolving," and "dissolvable" refer to compositions having aqueous-soluble components that interact with moisture in the oral cavity and enter into solution, thereby causing gradual consumption of the product. The physical characteristics of the product provided herein can vary, depending on the particular components and amounts thereof. Exemplary textural properties that can be obtained for the products disclosed herein include, but are not limited to, properties that can be described as lozenge-like (glassy), gum-like, gel-like, chewy, and rubbery. Accordingly, the specific physical properties of the smokeless tobacco products of the invention can be varied by adjusting the composition. For example, a lozenge-like texture can be provided by adjusting the amount of RuBisCO (e.g., to less than about 20% by weight), the amount of sugar alcohol (e.g., to greater than about 10%), and/or the amount of binder (e.g., to less than about 5%) to provide a glassier, lozenge-like product.

The protein-enriched material in the compositions and products disclosed herein is a material comprising at least about 50% protein by dry weight, at least about 60% protein by dry weight, at least about 70% protein by dry weight, at least about 80% protein by dry weight, at least about 90% protein by dry weight, at least about 95% protein by dry weight, at least about 98% protein by dry weight, or at least about 99% protein by dry weight. The protein-enriched material is generally plant-derived protein-enriched material. It is understood that the water-soluble portion of plant biomass generally consists of two fractions. One fraction predominantly comprises ribulose-1,5-bisphosphate carboxylase oxygenase (commonly referred to as RuBisCO), whose subunit molecular weight is about 550 kD (commonly referred to as a "Fraction 1 protein" or "F1 protein"). RuBisCO may comprise up to about 25% of the total protein content of a leaf and up to about 10% of the solid matter of a leaf. A second fraction ("Fraction 2 protein" or "F2 protein") generally contains a mixture of proteins and peptides with molecular weights ranging from about 3 kD to about 100 kD and may also contain other compounds including sugars, vitamins, alkaloids, flavors, and amino acids. The protein-enriched material incorporated within the compositions and products of the present disclosure can comprise Fraction 1 protein and/or Fraction 2 protein.

In some embodiments, the protein-enriched material is a RuBisCO-enriched material, e.g., a material comprising at least about 50% RuBisCO by dry weight, at least about 60% RuBisCO by dry weight, at least about 70% RuBisCO by dry weight, at least about 80% RuBisCO by dry weight, at least about 90% RuBisCO by dry weight, at least about 95% RuBisCO by dry weight, at least about 98% RuBisCO by dry weight, or at least about 99% RuBisCO by dry weight. In some embodiments, the protein-enriched material is an F2 protein-enriched material, e.g., a material comprising at least about 10% F2 protein by dry weight, at least about 20% F2 protein by dry weight, at least about 30% protein by dry weight, at least about 50% F2 protein by dry weight, at least about 60% F2 protein by dry weight, at least about 70% F2 protein by dry weight, at least about 80% F2 protein by dry weight, at least about 90% F2 protein by dry weight, at least about 95% F2 protein by dry weight, at least about 98% F2 protein by dry weight, or at least about 99% F2 protein by dry weight.

Where a combination of RuBisCO and F2 protein is used, the predominant protein can be either RuBisCO or F2 protein. In some embodiments, the protein in the protein-enriched material as a whole comprises at least about 50% RuBisCO by dry weight, at least about 60% RuBisCO by dry weight, at least about 70% RuBisCO by dry weight, at least about 80% RuBisCO by dry weight, at least about 90% RuBisCO by dry weight, at least about 95% RuBisCO by dry weight, at least about 98% RuBisCO by dry weight, or at least about 99% RuBisCO by dry weight. In some embodiments, the protein in the protein-enriched material as a whole comprises at least about 50% F2 protein by dry weight, at least about 60% F2 protein by dry weight, at least about 70% F2 protein by dry weight, at least about 80% F2 protein by dry weight, at least about 90% F2 protein by dry weight, at least about 95% F2 protein by dry weight, at least about 98% F2 protein by dry weight, or at least about 99% F2 protein by dry weight.

Particularly preferred protein-enriched materials for use in the compositions and products disclosed herein comprise RuBisCO. RuBisCO has been found to exhibit good nutritional properties and is colorless, tasteless, and odorless. Further, certain physical properties of RuBisCO render it advantageous for use in such products, as it has excellent binding, gelling, solubility, and emulsifying behavior. RuBisCO and F2 protein can be extracted from a wide array of plant materials and exemplary methods are described, for example, in U.S. Pat. No. 4,268,632 to Wildman et al., U.S. Pat. No. 4,340,676 to Bourke; U.S. Pat. No. 4,400,471 to Johal; U.S. Pat. No. 4,588,691 to Johal; and U.S. Pat. No. 6,033,895 to Garger et al., which are incorporated herein by reference. In certain preferred embodiments, the protein-enriched material is a tobacco-derived protein-enriched material. One exemplary tobacco-derived protein-enriched material is described in US Pat. App. Publ. No. 2014/0271952 to Mua et al., which is incorporated herein by reference in its entirety. Further details regarding additional processing of such materials to increase the purity thereof are provided in US Pat. App. Publ. No. 2014/0343254 to Gerardi et al., which is incorporated herein by reference.

The form of the protein-enriched materials (i.e., RuBisCO-enriched material, combined RuBisCO/F2 protein-enriched material, and/or F2 protein-enriched material) used according to the methods of the present disclosure can vary. Typically, these materials are in solid, liquid, or semi-solid or gel forms and formulations comprising such materials can be used in concrete, absolute, or neat form. Solid forms of the tobacco-derived materials described herein can include spray-dried and freeze-dried forms. Liquid forms of the tobacco-derived materials described herein can include formulations contained within aqueous or organic solvent carriers.

The amount of protein-enriched material incorporated within a tobacco composition or tobacco product according to the present disclosure can depend on the desired function of the protein-enriched material, the chemical makeup of the protein-enriched material, and the type of tobacco composition to which the protein-enriched, material is added. The amount of protein-enriched material added to a tobacco composition can vary, but will typically not exceed about 50 weight percent based on the total dry weight of the tobacco composition to which the composition is added. For example, the amount of protein-enriched, tobacco-derived material added to a tobacco composition as disclosed herein may be in the range of about 0.25 to about 30 weight percent, about 10 to about 30 weight percent, or about 1 to about 10 weight percent, based on the total dry weight of the tobacco composition.

The protein-enriched material can serve various functions within the smokeless tobacco products disclosed herein. For example, in some embodiments, the protein-enriched material can function as a gelling and/or binding agent. In some embodiments, the protein-enriched material (e.g., RuBisCO-enriched material) can serve as a replacement for at least a portion of the hydrocolloids (including, but not limited to, starch, gelatin, pectin, gums, and the like) in various products. In some embodiments, the protein-enriched material (e.g., RuBisCO-enriched material) can serve as a replacement for at least a portion of the fillers. In some embodiments, it may serve as a replacement for at least a portion of the tobacco (e.g., particulate, such as milled tobacco) found in some smokeless tobacco products.

The tobacco material contained in the compositions and products disclosed therein is generally a material comprising or derived from some form of a plant of the *Nicotiana* species. The selection of the plant from the *Nicotiana* species can vary; and in particular, the types of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and Rustica tobaccos, as well as various other rare or specialty tobaccos. Descriptions of various types of tobaccos, growing practices and harvesting practices are set forth in Tobacco Production, Chemistry and Technology, Davis et al. (Eds.) (1999), which is incorporated herein by reference. *Nicotiana* species can be derived using genetic-modification or crossbreeding techniques (e.g., tobacco plants can be genetically engineered or crossbred to increase or decrease production of or to other change certain components, characteristics or attributes). Additional information on types of *Nicotiana* species suitable for use in the present invention can be found in US Pat. Appl. Pub. No. 2012/0192880 to Dube et al., which is incorporated by reference herein. Tobacco plants can be grown in greenhouses, growth chambers, or outdoors in fields, or grown hydroponically.

The portion or portions of the plant of the *Nicotiana* species used according to the present invention can vary. For example, virtually all of the plant (e.g., the whole plant) can be harvested, and employed as such. Alternatively, various parts or pieces of the plant can be harvested or separated for further use after harvest. For example, the leaves, stem, stalk, roots, lamina, flowers, seed, and various portions and combinations thereof, can be isolated for further use or treatment. The plant material of the invention may thus comprise an entire plant or any portion of a plant of the *Nicotiana* species. See, for example, the portions of tobacco plants set forth in US Pat. Appl. Pub. Nos. 2011/0174323 to Coleman, III et al. and 2012/0192880 to Dube et al., which are incorporated by reference herein.

The plant of the *Nicotiana* species can be employed in either an immature or mature form, and can be used in either a green form or a cured form, as described in 2012/0192880 to Dube et al., which is incorporated by reference herein. The tobacco material can be subjected to various treatment processes such as, refrigeration, freezing, drying (e.g., freeze-drying or spray-drying), irradiation, yellowing, heating, cooking (e.g., roasting, frying or boiling), fermentation, bleaching, or otherwise subjected to storage or treatment for later use. Exemplary processing techniques are described, for example, in US Pat. Appl. Pub. Nos. 2009/0025739 to Brinkley et al. and 2011/0174323 to Coleman, III et al., which are incorporated by reference herein.

Tobacco materials can be treated with enzymes and/or probiotics before or after harvest, as discussed in US Pat. Appl. Pub. Nos. 2013/0269719 Marshall et al. and 2014/0020694 to Moldoveanu, which are incorporated herein by reference. Tobacco materials may be irradiated, pasteurized, or otherwise subjected to controlled heat treatment. Representative processes are set forth in US Pat. Pub. Nos. 2009/0025738 to Mua et al.; 2009/0025739 to Brinkley et al.; and 2011/0247640 to Beeson et al., which are incorporated herein by reference. In one embodiment, the tobacco material is heat treated in the presence of water, NaOH, and an additive (e.g., lysine) at about 88° C. for about 60 minutes. Such heat treatment can help prevent acrylamide production resulting from reaction of asparagine with reducing sugars in tobacco materials and can provide some degree of pasteurization. See, for example, US Pat. Pub. No. 2010/0300463 to Chen et al., which is incorporated herein by reference. The tobacco material can be brought into contact with an imprinted polymer or non-imprinted polymer such as described, for example, in US Pat. Pub. Nos. 2007/0186940 to Bhattacharyya et al; 2011/0041859 to Rees et al.; 2011/0159160 to Jonsson et al; and 2012/0291793 to Byrd et al., all of which are incorporated herein by reference.

A harvested portion or portions of the plant of the *Nicotiana* species can be physically processed. A portion or portions of the plant can be separated into individual parts or pieces (e.g., roots can be removed from stalks, stems can be removed from stalks, leaves can be removed from stalks and/or stems, petals can be removed from the remaining portion of the flower). The harvested portion or portions of the plant can be further subdivided into parts or pieces (e.g., shredded, cut, comminuted, pulverized, milled or ground into pieces or parts that can be characterized as filler-type pieces, granules, particulates or fine powders). The harvested portion or portions of the plant can be subjected to external forces or pressure (e.g., by being pressed or subjected to roll treatment). When carrying out such processing conditions, the harvested portion or portions of the plant can have a moisture content that approximates its natural moisture content (e.g., its moisture content immediately upon harvest), a moisture content achieved by adding moisture to the harvested portion or portions of the plant, or a moisture content that results from the drying of the harvested portion or portions of the plant.

In certain embodiments, the tobacco material is used in a form that can be described as particulate (i.e., shredded, ground, granulated, or powder form). The manner by which the tobacco material is provided in a finely divided or powder type of form may vary. Preferably, plant parts or pieces are comminuted, ground or pulverized into a particulate form using equipment and techniques for grinding, milling, or the like. Most preferably, the plant material is relatively dry in form during grinding or milling, using equipment such as hammer mills, cutter heads, air control mills, or the like. For example, tobacco parts or pieces may be ground or milled when the moisture content thereof is less than about 15 weight percent or less than about 5 weight percent. Most preferably, the tobacco material is employed in the form of parts or pieces that have an average particle size less than about 50 microns. In one embodiment, the average particle size of the tobacco particles may be less than or equal to about 25 microns. In some instances, the tobacco particles may be sized to pass through a screen mesh. If desired, air classification equipment may be used to ensure that small sized tobacco particles of the desired sizes, or range of sizes, may be collected. If desired, differently sized pieces of granulated tobacco may be mixed together. Use of micro-milled tobacco particles (or other micro-sized botanical components) can be advantageous where the user prefers to reduce or eliminate product waste after use.

In certain embodiments, at least a portion of the tobacco material employed in the tobacco composition or product can have the form of an extract. Tobacco extracts can be obtained by extracting tobacco using a solvent having an aqueous character such as distilled water or tap water. As such, aqueous tobacco extracts can be provided by extracting tobacco with water, such that water insoluble pulp material is separated from the aqueous solvent and the water soluble and dispersible tobacco components dissolved and dispersed therein. Exemplary techniques for extracting components of tobacco are described in U.S. Pat. No. 4,144,895 to Fiore; U.S. Pat. No. 4,150,677 to Osborne, Jr. et al.; 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,284,875 to Turpen et al.; U.S. Pat. No. 6,298,859 to Kierulff et al.; U.S. Pat. No. 6,772,767 to Mua et al.; U.S. Pat. No. 6,817,970 to Befit et al.; U.S. Pat. No. 6,906,172 to Bratcher et al.; U.S. Pat. No. 7,034,128 to Turpen et al.; U.S. Pat. No. 7,048,211 to Bratcher et al.; and 7,337,782 to Thompson, all of which are incorporated by reference herein. See also, the ultrafiltered translucent tobacco extracts set forth in US Pat. Appl. Pub. Nos. 2013/0074855 and 2013/0074856, both to Holton, Jr., which are incorporated by reference herein.

Tobacco-derived extracts will typically comprise a mixture of desired components isolated from a plant of the *Nicotiana* species by various means. However, if desired, the tobacco-derived extract can be highly purified with respect to a single component of the extract or a small number of extract components. Typical separation processes that can further purify or isolate components of a tobacco extract include one or more process steps such as solvent extraction (e.g., using polar solvents, organic solvents, or supercritical fluids), chromatography (e.g., preparative liquid chromatography), clarification, distillation, filtration (e.g., ultrafiltration), recrystallization, and/or solvent-solvent partitioning. In some embodiments, a plant or a portion thereof is pre-treated, e.g., to liberate certain compounds to make the desired compounds available for more efficient separation. In some embodiments, multiple methods are used to isolate and/or purify the desired compounds. See, for example, the description of isolated tobacco components and techniques for isolation in US Pat. Appl. Pub. Nos. 2011/0174323 to Coleman, III et al.; 2011/0259353 to Coleman, III et al.; 2012/0192880 to Dube et al.; 2012/0192882 to Dube et al.; and 2012/0211016 to Byrd, Jr. et al., which are incorporated by reference herein.

Tobacco extracts used in the smokeless tobacco compositions and products of the present disclosure can, in some embodiments, be characterized as translucent or transparent. In certain embodiments, such extracts can be characterized by the molecular weight of their components. For example, a translucent tobacco extract can consist of compounds having a molecular weight of less than about 50,000 Da., or compounds having a molecular weight of less than about 5,000 Da. The translucency of a tobacco extract can be characterized by a percent light transmittance (compared to water at 100% transmittance), such as a percent light transmittance of at least about 30% at visible light wavelengths greater than about 600 nm, or a percent light transmittance of at least about 40% at visible light wavelengths greater than about 600 nm, or a percent light transmittance of at least about 50% at visible light wavelengths greater than about 600 nm (or even higher levels such as greater than about 60% or greater than about 70% or greater than about 80% at visible light wavelengths greater than about 600 nm).

Reference to "tobacco extract" as explained above encompasses extracts highly purified with respect to one or a few components thereof. For example, highly purified tobacco-derived nicotine (e.g., pharmaceutical grade nicotine having a purity of greater than 98% or greater than 99%) or a derivative thereof can be used in the present invention. Representative nicotine-containing extracts can be provided using the techniques set forth in U.S. Pat. No. 5,159,942 to Brinkley et al., which is incorporated herein by reference. Extracts containing relatively high nicotine content can be buffered, e.g., using buffering agents such as citric acid to lower the pH of the extracts. Tobacco extracts (or isolates thereof) can be provided and incorporated into the compositions and products disclosed herein in solid (e.g., spray-dried or freeze-dried, including freeze-dried flue cured extract or spray-dried fire-cured extract), liquid (e.g., formulations contained within aqueous or organic solvent carriers), or semi-solid form.

In certain embodiments, the compositions and products of the invention can include nicotine in any form from any source, whether tobacco-derived or synthetically-derived. Normally, nicotinic compounds used in the present invention are selected from the group consisting of nicotine base, nicotine hydrochloride, nicotine dihydrochloride, nicotine monotartrate, nicotine bitartrate, nicotine sulfate, nicotine zinc chloride such as nicotine zinc chloride monohydrate and nicotine salicylate. In some embodiments, nicotine is in its free base form, which can optionally be sorbed on a carrier (e.g., microcrystalline cellulose) for inclusion in a smokeless tobacco product. See, for example, the nicotine/carrier compositions set forth in US Pat. Pub. No. 2004/0191322 to Hansson, which is incorporated by reference herein.

The relative amount of tobacco material within the smokeless tobacco composition may vary, and depends in part on the type of tobacco material employed (e.g., milled tobacco or tobacco extract). Preferably, the total amount of tobacco material (from any source including tobacco extracts or isolates and particulate tobacco material) within the smokeless tobacco products of the present disclosure is between about 0.01 and about 50 weight percent based on total weight of the composition, more typically between about 0.2 and about 40 weight percent. For embodiments containing only tobacco extract as the tobacco component (including pharmaceutical grade nicotine), the products will typically contain no more than about 10 weight percent of tobacco component, such as no more than about 8 weight percent, no more than about 5 weight percent, or no more than about 3 weight percent (e.g., about 0.01 to about 10 weight percent). For embodiments containing a particulate tobacco component (e.g., a finely milled tobacco), either as the sole tobacco component or in combination with a tobacco extract, the products will typically contain no more than about 60 weight percent of tobacco component, such as no more than about 50 weight percent or no more than about 40 weight percent (e.g., about 10 to about 50 weight percent or about 20 to about 40 weight percent). The amount of tobacco material (or combination of tobacco material with other botanical components) will typically not exceed 50 weight percent.

In addition to (or in lieu of in certain embodiments) the above-noted tobacco material, products of the invention can optionally include a further non-tobacco botanical material. As used herein, the term "botanical material" refers to any plant material, including plant material in its natural form and plant material derived from natural plant materials, such as extracts or isolates from plant materials or treated plant materials (e.g., plant materials subjected to heat treatment, fermentation, or other treatment processes capable of altering the chemical nature of the material). For the purposes of the present disclosure, a "botanical material" includes but is not limited to "herbal materials," which refer to seed-producing plants that do not develop persistent woody tissue and are often valued for their medicinal or sensory characteristics (e.g., teas or tisanes). Certain botanical materials of this type are sometimes referred to as dietary supplements, nutraceuticals, "phytochemical s" or "functional foods." Exemplary botanical materials, many of which are associated with antioxidant characteristics, include without limitation acai berry, alfalfa, allspice, annatto seed, apricot oil, basil, bee balm, wild bergamot, black pepper, blueberries, borage seed oil, bugleweed, cacao, calamus root, catnip, catuaba, cayenne pepper, chaga mushroom, chervil, cinnamon, dark chocolate, potato peel, grape seed, ginseng, *gingko biloba*, Saint John's Wort, saw palmetto, green tea, black tea, black cohosh, cayenne, chamomile, cloves, cocoa powder, cranberry, dandelion, grapefruit, honeybush, echinacea, garlic, evening primrose, feverfew, ginger, goldenseal, hawthorn, hibiscus flower, jiaogulan, kava, lavender, licorice, marjoram, milk thistle, mints (menthe), oolong tea, beet root, orange, oregano, papaya, pennyroyal, peppermint, red clover, rooibos (red or green), rosehip, rosemary, sage, clary sage, savory, spearmint, spirulina, slippery elm bark, sorghum bran hi-tannin, sorghum grain hi-tannin, sumac bran, comfrey leaf and root, goji berries, gutu kola, thyme, turmeric, *uva ursi*, valerian, wild yam root, wintergreen, yacon root, yellow dock, yerba mate, yerba santa, *bacopa monniera, withania somnifera*, and *silybum marianum*. When present in the composition, such botanical materials can be used in the same forms noted above with respect to tobacco (e.g., milled particulates or extracts) and the amounts utilized are typically such that the total tobacco and non-tobacco botanical material falls within the total amounts given above for tobacco materials in the compositions of the invention.

In certain embodiments, the non-tobacco botanical will provide advantageous sensory characteristics (e.g., taste, aroma, or color) or other functional benefits, such as function as a binder or filler. In certain embodiments, the non-tobacco botanical may be associated with desirable bioactivity or health-related effects such as antioxidant qualities.

In particularly preferred embodiments, the non-tobacco botanical components will complement the sensory characteristics associated with tobacco-derived materials in the formulation, and in some cases, will even contribute tobacco-like sensory characteristics. In some embodiments, the presence of the non-tobacco botanical is associated with mouth and throat sensory characteristics that are not dissonant with the overall desirable sensory characteristics of the product and, in some cases, can contribute to a reduction in mouth and/or throat irritation otherwise associated with the formulation. Green tea (*Camellia sinesis*), guayusa, rooibos (particularly green rooibos) and honeybush (particularly red honeybush) are particularly advantageous non-tobacco botanical components that can lead to certain desirable characteristics as set forth above.

In addition to the protein-enriched material and the tobacco material, the smokeless tobacco compositions of the disclosure typically include at least one sugar substitute. The sugar substitute can be any sugarless material (i.e., sucrose-free material) and can be natural or synthetically produced. The sugar substitute used in the invention can be nutritive or non-nutritive. For example, the sugar substitute is commonly a sugar alcohol and, often, the compositions of the invention contain a plurality of sugar alcohols. Sugar alcohols are polyols derived from monosaccharides or disaccharides that have a partially or fully hydrogenated form. Exemplary sugar alcohols have between about 4 and about 20 carbon atoms and include erythritol, arabitol, ribitol, isomalt, polyglycitol, maltitol, dulcitol, iditol, mannitol, xylitol, lactitol, sorbitol, and combinations thereof (e.g., hydrogenated starch hydrolysates). Sugar alcohols can fulfill multiple functions, such as providing sweetness, enhancing certain organoleptic properties such as texture and mouthfeel, enhancing cohesiveness or compressibility of the product, and the like.

A combination of sugar alcohols is typically utilized in the present invention. The exact combination of sugar alcohols used in any given formulation can be selected based on a number of factors, including laxation threshold, relative sweetness, calorie content, glycemic index, degree of hygroscopicity, and the like. In one embodiment, a combination of two or more of xylitol, maltitol, and sorbitol is used. Interestingly, this particular combination of sugar alcohols provides a chewy product that has a moderate cooling effect in the mouth. In certain embodiments, a combination of sorbitol, erythritol, and isomalt or maltitol, erythritol, and isomalt is used in a "chewy gel" type product. In certain embodiments, sucrose and sorbitol are used in a "pastille" type product. In some embodiments, xylitol, sorbitol, and maltitol are used in an "extruded rod" type product.

Where a combination of sugar alcohols is used, the ratio of the sugar alcohols with respect to one another can vary. In some embodiments, each sugar alcohol is provided in roughly the same weight percentage. In other embodiments, the sugar alcohols can be provided in different weight percentages (with one or more sugar alcohols being principal sugar alcohol component(s) and one or more sugar alcohols being minor sugar alcohol component(s)).

The total sugar alcohol content of the compositions of the invention will typically range from about 5 to about 75 weight percent based on total dry weight of the product, such as about 10 to about 50 weight percent, or about 10 to about 25 weight percent. The total sugar alcohol content of the product will typically be at least about 10 weight percent, or at least about 15 weight percent based on total dry weight of the product. The sugar alcohol content of the products will typically not exceed about 90 weight percent, such as no more than about 85 weight percent, no more than about 80 weight percent, no more than 75 weight percent, or no more than about 50 weight percent.

The compositions disclosed herein generally further comprise one or more filler materials. Exemplary filler materials include, but are not limited to, grains (including processed grains and puffed grains), maltodextrin, dextrose, calcium carbonate, calcium phosphate, starches (e.g., corn starch), flours (e.g., rice flour), lactose, modified or natural cellulosic materials (e.g., finely divided cellulose, microcrystalline cellulose), bran fibers, vegetable fiber materials such as sugar beet fiber materials (e.g., FIBREX brand filler, available from International Fiber Corporation), and the like. In certain embodiments, the products disclosed herein can comprise a polysaccharide filler and a starch filler. Specific fillers that are advantageously incorporated within the compositions and products of the present disclosure include, but are not limited to, rice flour, maltodextrin, and/or calcium carbonate. In preferred embodiments, one, two, or all three of these fillers are incorporated within a smokeless tobacco composition or product as described herein. In some embodiments, the filler material comprises one or more starches and, in certain embodiments, selection of the specific starch or starches can impact the textural properties of the composition and product into which it is incorporated. See, e.g., U.S. Pat. App. Publ. No. 2013/0118512 to Jackson et al., which is incorporated herein by reference.

The total filler content of the compositions of the invention will typically range from about 5 to about 75 weight percent based on total dry weight of the product, such as about 5 to about 50 weight percent, about 8 to about 50 weight percent, about 5 to about 25 weight percent, about 8 to about 25 weight percent, or about 8 to about 15 weight percent. The total filler content of the product will typically be at least about 5 weight percent, at least about 10 weight percent, or at least about 15 weight percent based on total dry weight of the product. The filler content of the products will typically not exceed about 90 weight percent, such as no more than about 85 weight percent, no more than about 80 weight percent, no more than 75 weight percent, or no more than about 50 weight percent.

The compositions disclosed herein can further comprise a binder (or combination of binders). The binder or binders can be incorporated in an amount sufficient to provide the desired physical attributes and physical integrity to the smokeless tobacco composition. In some embodiments, a binder/agglumerant comprising pregelatinized corn starch is employed, e.g., in an amount of at least about 1% by dry weight, at least about 2% by dry weight, or at least about 5% by dry weight, such as between about between about 5 percent and about 20 percent by dry weight. Other binders include, but are not limited to, povidone, sodium carboxymethylcellulose (CMC) and other modified cellulosic types of binders, sodium alginate, polydextrose, and starch-based binders. In certain embodiments, the binder material includes a natural gum. As used herein, a natural gum refers to a polysaccharide material of natural origin that is useful as a thickening, binding, or gelling agent. Representative natural gums derived from plants, which are typically water soluble to some degree, include agar agar, xanthan gum, guar gum, gum arabic, ghatti gum, gum tragacanth, karaya gum, locust bean gum, gellan gum, and combinations thereof. Particularly preferred according to the present invention is xanthan gum. When present, natural gum binder materials are typically present in an amount of at least about 1 weight percent or at least about 2 weight percent (e.g., between about 1 and about 10 weight percent, between about 1 and about 5 weight percent or between about 2 and about 5 weight percent). In particular embodiments, two or more binders (e.g., pregelatinized corn starch and a natural gum binder) are used in combination.

As referenced above, tobacco-derived, protein-enriched material as disclosed herein can, in some embodiments, provide binding capabilities. As such, it can be used in combination with any one or more of the other types of binders disclosed herein or can replace one or more of the other types of binders disclosed herein, in whole or in part. In certain, non-limiting embodiments, tobacco-derived RuBisCO can be used in combination with a gum binder (e.g., gum arabic).

Although not intending to be limited, a disintegration or compressibility aid is commonly incorporated into the compositions and products disclosed herein. Exemplary disintegration or compressibility aids include microcrystalline cellulose, croscarmellose sodium, crospovidone, calcium carbonate, and sodium starch glycolate. The optional disintegration or compressibility aid can be incorporated in amounts of at least about 0.5 percent by dry weight, at least about 1 percent by dry weight, or at least about 2 percent by dry weight. For example, in certain embodiments, the compositions and products disclosed herein can comprise between about 0.5 and about 10 percent by weight, such as between about 1 and about 5 percent by weight of a disintegration or compressibility aid.

A humectant (e.g., glycerin or propylene glycol) may be employed in an amount sufficient to provide desired moisture attributes to the protein-enriched smokeless tobacco compositions and products disclosed herein. Further, in some instances, the humectant may impart desirable flow characteristics to the smokeless tobacco composition. When present, a representative amount of humectant is at least about 0.1 weight percent or at least about 0.2 weight percent, but will typically make up less than about 20 percent of the total weight of the composition (e.g., about 0.1 weight percent to about 2 weight percent, such as from about 0.1 weight percent to about 1 weight percent).

The tobacco material (and/or botanical material) formulation used for the manufacture of the smokeless tobacco compositions and products disclosed herein can be processed, blended, formulated, combined, and/or mixed with one or more other materials or ingredients in addition to those components noted above. See, for example, those representative components, combination of components, relative amounts of those components and ingredients relative to tobacco, and manners and methods for employing those components, set forth in US Pat. Pub. Nos. 2007/0062549 to Holton, et al. and 2007/0186941 to Holton, et al., each of which is incorporated herein by reference.

Accordingly, protein-enriched smokeless tobacco compositions and products are provided herein that can further comprise one or more additional components. The additional components can be artificial, or can be obtained or derived from herbal or biological sources. Exemplary types of further components include salts (e.g., sodium chloride, potassium chloride, sodium citrate, potassium citrate, sodium acetate, potassium acetate, flour salt, and the like), natural sweeteners (e.g., fructose, sucrose, glucose, maltose, vanillin, ethylvanillin glucoside, mannose, galactose, lactose, *stevia*, and the like), artificial sweeteners (e.g., sucralose, sucrose, isomaltulose, saccharin, aspartame, acesulfame K, neotame and the like), gelling agents (e.g., fish gelatin, sorghum malt, or carrageenan), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), emulsifiers, colorants (e.g., dyes and pigments, including caramel coloring, titanium dioxide, and the like), humectants (e.g., glycerin and the like), effervescing materials such as certain acid/base combinations, lipids/oils (e.g., coconut oil, lecithin, such as sunflower lecithin, palm kernel oil, and palm oil), oral care components (e.g., thyme oil, *eucalyptus* oil, food-grade Aloe Vera gel, and zinc), preservatives (e.g., potassium sorbate and the like), syrups (e.g., honey, high fructose corn syrup, corn syrup, and the like), flavorant and flavoring mixtures, antioxidants, and mixtures thereof. Exemplary encapsulated components are described, for example, in WO 2010/132444 to Atchley, which is incorporated by reference herein. Other exemplary types of components may include those described in, for example, U.S. Pat. Pub. Nos. 2010/0291245 to Gao et al., 2012/0055494 to Hunt et al. and 2012/0199145 to Byrd et al., which are incorporated by reference herein.

Such components may be provided in a powder or granulated form for mixing with the tobacco material formulation, or otherwise may be provided in liquid form. Most preferably, additional components when provided in a powder or granulated form are employed in the form of parts or pieces that have an average particle size less than about 50 microns. According to some aspects, the average particle size of the components may be about 25 microns or less. The moisture content of the components provided in a powder or granulated form may vary. The particular percentages and choice of ingredients will vary depending upon the desired flavor, texture, and other characteristics.

As used herein, a "flavorant" or "flavoring agent" is any flavorful or aromatic substance capable of altering the sensory characteristics associated with the smokeless tobacco composition. Exemplary sensory characteristics that can be modified by the flavorant include, taste, mouthfeel, moistness, coolness/heat, and/or fragrance/aroma. The flavorants can be natural or synthetic, and the character of these flavors can be described as, without limitation, fresh, sweet, herbal, confectionary, floral, fruity or spice. Specific types of flavors include, but are not limited to, vanilla, coffee, chocolate, cocoa, cream, mint (e.g., mint oil), spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. Flavorants utilized in the disclosure also can include components that are considered moistening, cooling or smoothening agents, such as *eucalyptus*. These flavors may be provided neat (i.e., alone) or in a composite (e.g., spearmint and menthol or orange and cinnamon). In some instances, the flavorant may be provided in a spray-dried form or a liquid form. Flavorants are typically present in an amount of about 0.05 to about 5 weight percent, often about 0.1 to about 2 weight percent.

Sweeteners can be used in natural or artificial form or as a combination of artificial and natural sweeteners. In certain embodiments, the compositions can advantageously comprise sucralose as a sweetener. When present, a representative amount of sweetener, whether an artificial sweetener and/or natural sugar, may make up at least about 0.001 percent, at least about 0.01 percent, or at least about 0.1 percent of the total weight of the composition. Typical protein-enriched smokeless tobacco compositions described herein comprise less than about 10 percent, less than about 8 percent, less than about 5 percent, or less than about 2 percent sweetener by weight. An exemplary range of sweetener in the smokeless tobacco compositions of the present disclosure is between about 0.001 percent and about 2 percent by weight, e.g., between about 0.01 percent and about 1 percent by weight or between about 0.1 percent and about 1 percent by weight.

A salt (e.g., sodium chloride or flour salt) may be employed in amounts sufficient to provide desired sensory attributes to the protein-enriched smokeless tobacco compositions and products described herein. When present, a representative amount of salt is at least about 0.1 weight percent or at least about 0.2 weight percent, but will typically may make up less than about 10 percent of the total weight of the composition (e.g., about 1 to about 10 weight percent or about 1 to about 5 weight percent).

In some embodiments, one or more lipids can be incorporated within the compositions and products disclosed herein. Such lipids can include, but are not limited to, fats, oils, or wax substances (or a combination thereof). Exemplary fats that can be used include palm oil, palm kernel oil, soybean oil, cottonseed oil, and mixtures thereof. According to some aspects, the lipid may be hydrogenated, partially hydrogenated, or non-hydrogenated. In some instances, the lipid substance may include a blend of lipid components. For example, the lipid substance may include a blend of palm oil and palm kernel oil. Further information regarding lipid components is provided, for example, in US Pat. Pub. No. 2012/0037175 to Cantrell et al., which is incorporated by reference herein. The relative amount of lipid substance within the smokeless tobacco composition may vary. Where present, the lipid component can, in some embodiments, be present in an amount of at least about 2 percent or at least about 5 percent by weight based on total weight of the composition (e.g., between about 2 and about 10 percent by weight).

The acidity or alkalinity of the smokeless tobacco product, which is often characterized in terms of pH, can vary and will depend, in part, on whether the product is formulated with a pH adjuster (e.g., citric acid) or buffering agent. Typically, the pH of the formulation will fall within the range of about 4 to about 9. If a base or alkaline buffering agent is present, the pH is typically toward the upper end of the range, such as about 6.5 to about 8. If the product is formulated without a pH adjuster or buffering agent, in certain embodiments, the pH will range from about 4.5 to about 6.5. In particularly preferred embodiments, the products provided herein are provided at a pH of from about 7.0 to about 8.2. A representative technique for determining the pH of a smokeless tobacco formulation involves dispersing 5 g of that formulation in 100 ml of high performance liquid chromatography water, and measuring the pH of the resulting suspension/solution (e.g., with a pH meter). Preferred buffering agents buffer within a pH range of about 6 to about 10, and exemplary buffering agents include metal hydroxides (e.g., NaOH), metal carbonates, metal bicarbonates, or mixtures thereof. The buffering agent, where present is typically present in an amount less than about 1 percent based on the weight of the composition.

Certain representative smokeless tobacco compositions may incorporate about 25 to about 50 percent by weight particulate tobacco, about 1 to about 10 percent by weight protein-enriched material (e.g., tobacco extract comprising at least about 50%, at least about 60%, at least about 70%, at least about 80%, at least about 90%, at least about 95%, at least about 98%, or at least about 99% RuBisCO and/or F2 protein, about 10 to about 30 percent by weight of one or more sugar alcohols, about 5 to about 20 percent by weight of one or more fillers, about 2 to about 10 percent by weight of one or more natural gum binders, and about 10 to about 20 percent of one or more (non-natural gum) binders.

Representative protein-enriched smokeless tobacco products according to the present invention can have various types of formats and configurations, and as a result, the character, nature, behavior, consistency, shape, form, size and weight of the composition can vary. The shape of a representative composition can be generally spherical, cylindrical (e.g., ranging from the general shape of a flattened disc to the general shape of a relatively long, slender stick), helical, obloid, square, rectangular, or the like; or the composition can have the form of a bead, capsule, film, strip, or the like. The shape of the composition can resemble a wide variety of pill, tablet, lozenge, capsule, and caplet types of products. Various types of smokeless tobacco products are described or referenced in US Pat. Appl. Pub. No 2012/0152265 to Dube et al., which is incorporated herein by reference. According to one aspect, a smokeless tobacco product as disclosed herein is preferably capable of lasting in the user's mouth for between about 1 and about 30 minutes until it completely dissolves.

The present disclosure also provides methods for preparing protein-enriched smokeless tobacco products. In some embodiments, a method is provided wherein tobacco is treated (e.g., subjected to extraction) to provide a protein-enriched material, e.g., a material comprising at least about 50% protein by dry weight, at least about 60% protein by dry weight, at least about 70% protein by dry weight, at least about 80% protein by dry weight, or at least about 85% protein by dry weight and the resulting protein-enriched material is incorporated within a smokeless tobacco composition. As noted above, the tobacco treatment step can provide a protein-enriched material comprising a mixture of RuBisCO and F2 proteins, primarily RuBisCO, or primarily F2 proteins. Further details regarding exemplary processing steps to obtain tobacco-derived protein-enriched material are provided in US Pat. App. Publ. No. 2014/0271952 to Mua et al. and US Pat. App. Publ. No. 2014/0343254 to Gerardi et al., which are incorporated herein by reference.

The means by which the protein-enriched smokeless tobacco products can be produced can vary and generally, the components of the products can be combined by any means for providing such a formulation and/or product. Exemplary means for providing certain types of formulations are provided herein, although it is noted that other methods can be used without departing from the present invention. For example, the various components of the protein-enriched smokeless tobacco composition may be contacted, combined, or mixed together in conical-type blenders, mixing drums, ribbon blenders, or the like, such as a Hobart mixer. As such, the overall mixture of various components with the tobacco material may, in some embodiments, be relatively uniform in nature. See also, for example, the types of methodologies set forth in U.S. Pat. No. 4,148,325 to Solomon et al.; U.S. Pat. No. 6,510,855 to Korte et al.; and 6,834,654 to Williams, each of which is incorporated herein by reference.

Typical conditions associated with manufacture of food grade products such as described herein include control of heat and temperature (i.e., the degree of heat to which the various ingredients are exposed during manufacture and the temperature of the manufacturing environment), moisture content (e.g., the degree of moisture present within individual ingredients and within the final composition), humidity within the manufacturing environment, atmospheric control (e.g., nitrogen atmosphere), airflow experienced by the various ingredients during the manufacturing process, and other similar types of factors. Additionally, various process steps involved in product manufacture can involve selection of certain solvents and processing aids, use of heat and radiation, refrigeration and cryogenic conditions, ingredient mixing rates, and the like. The manufacturing conditions also can be controlled due to selection of the form of various ingredients (e.g., solid, liquid, or gas), particle size or crystalline nature of ingredients of solid form, concentration of ingredients in liquid form, or the like. Ingredients can be processed into the desired composition by techniques such as extrusion, compression, spraying, and the like.

Although in some embodiments, the components of the protein-enriched materials described herein (e.g., the tobacco material and/or the protein-enriched material) and/or the protein-enriched product can be used directly, it may be desirable to thermally treat the material or product in order to, for example, pasteurize the material or otherwise chemically alter the material. For example, a tobacco material can be thermally processed by mixing the tobacco material, water, and an additive selected from the group consisting of lysine, glycine, histidine, alanine, methionine, glutamic acid, aspartic acid, proline, phenylalanine, valine, arginine, di- and trivalent cations, asparaginase, saccharides, phenolic compounds, reducing agents, compounds having a free thiol group, oxidizing agents (e.g., hydrogen peroxide), oxidation catalysts, plant extracts, and combinations thereof, to form a moist tobacco mixture; and heating the moist tobacco mixture at a temperature of at least about 60° C. to form a heat-treated tobacco mixture. In one embodiment, the treated tobacco extract is heat treated in the presence of water, NaOH, and an additive (e.g., lysine) at about 88° C.

for about 60 minutes. Such heat treatment can help prevent acrylamide production resulting from reaction of asparagine with reducing sugars in tobacco materials and can provide some degree of pasteurization. See, for example, US Pat. Pub. No. 2010/0300463 to Chen et al., which is incorporated herein by reference. In certain embodiments wherein a heat-treated tobacco-derived material is used in a smokeless tobacco product of the present invention, the product can be characterized by very low acrylamide content. For example, in some embodiments, the smokeless tobacco product is characterized by an acrylamide content of less than about 500 ppb (ng/g), less than about 400 ppb, less than about 300 ppb, less than about 200 ppb, or less than about 100 ppb. In some embodiments, in addition to or in place of the optional heat treatment, tobacco material can be irradiated (e.g., to ensure no microbes are associated with the treated protein-enriched material).

The presence of protein-enriched material (e.g., tobacco-derived protein-enriched material) in a smokeless tobacco composition can enhance a tobacco composition in a variety of ways, depending on the nature of the protein-enriched material and the type of tobacco composition to which it is added. Exemplary protein-enriched extracts, solids fractions, and combinations thereof can serve to provide flavor and/or aroma to a tobacco product (e.g., the composition can alter the sensory characteristics of tobacco compositions or smoke derived therefrom). Other protein-enriched extracts, solids fractions, and combinations thereof can serve functional purposes within tobacco compositions, such as binder or filler functions. Certain protein-enriched extracts, solids fractions, and combinations thereof can serve as a replacement for one or more traditional components of a tobacco product.

In certain embodiments, the protein-enriched material in the smokeless tobacco compositions disclosed herein can involve use of a tobacco material or non-tobacco plant material as a carrier for the protein-enriched material, such as by absorbing the protein-enriched material (i.e., RuBisCO-enriched material, combined RuBisCO/F2 protein-enriched material, and/or F2 protein-enriched material) into the tobacco or other plant material or otherwise associating tobacco-derived, protein-enriched material with the carrier material. The types of tobacco that can serve as the carrier for the formulations of the invention can vary, and can include any of the tobacco types discussed herein, including various cured tobacco materials (e.g., flue-cured or air-cured tobaccos) or portions thereof (e.g., tobacco lamina or tobacco stems).

EXPERIMENTAL

Aspects of the present invention is more fully illustrated by the following examples, which are set forth to illustrate certain aspects of the present invention and is not to be construed as limiting thereof.

Example 1: Extruded Rods

Dry Blend:

| Ingredient | Weight percent | Grams per batch |
|---|---|---|
| Heat treated tobacco leaves and stem (blend of 75% flue cured tobacco and 25% sun cured tobacco) | 36 | 108 |

-continued

| Ingredient | Weight percent | Grams per batch |
|---|---|---|
| Sucralose | 0.65 | 1.95 |
| Titanium dioxide | 1 | 3 |
| Xylitol (granular) | 5 | 15 |
| Maltitol powder | 7.68 | 23.04 |
| Sorbitol powder | 4.8 | 14.4 |
| Calcium carbonate | 3 | 9 |
| Maltodextrin | 4.395 | 13.185 |
| Rice flour | 6 | 18 |
| Tobacco-derived RuBisCO (crude)-50-95% pure | 4 | 12 |
| Xanthan gum | 4 | 12 |
| Pregelatinized rice starch | 14 | 42 |
| Cocoa powder | 1.62 | 4.86 |
| Licorice powder | 0.2 | 0.6 |

Wet Blend:

| Ingredient | Weight percent | Grams per batch |
|---|---|---|
| Sodium hydroxide | 0.4 | 1.2 |
| Vanilla | 0.03 | 0.09 |
| Glycerin | 0.5 | 1.5 |
| Sodium chloride | 3.6 | 10.8 |
| Dry flavoring | 3.12 | 9.36 |

The dry blend and wet blend are independently prepared based on the ingredients and amounts in the tables above. The wet blend is specifically prepared by dissolving the sodium hydroxide in water and subsequently adding the remaining components of the wet blend. The wet blend is slowly added to the dry ingredients while mixing in a pasta maker. The resulting mixture is extruded from the pasta maker to give approximately 1 foot long rods (through a die with a diameter of about 3.15 mm). The die is adapted to produce four rods at a time by blocking all but four holes on the die during use. The extruded rods are placed on 22.5 inch diameter corrugated metal screens (designed to keep the rods straight while drying) and placed on rotating trays in an oven at 138° C. to dry.

Example 2: Pastille A (RuBisCO as Filler)

Dry Blend:

| Ingredient | Weight percent | Grams per batch |
|---|---|---|
| Tobacco-derived RuBisCO powder | 29.29 (90% solids) | 650.97 |
| Tobacco extract (spray dried) | 4.58 (90% solids) | 101.78 |
| Sucralose | 1.04 (99% solids) | 21.10 |
| Flavorant | 4.23 (95% solids) | 89.34 |

Wet Blend:

| Ingredient | Weight percent | Grams per batch |
|---|---|---|
| Sodium hydroxide | 0.20 | 4.00 |
| Gum Arabic | 28.37 (90% solids) | 630.35 |
| Sorbitol liquid | 23.53 (70% solids) | 672.29 |
| Sodium chloride | 2.36 | 47.32 |

-continued

| Ingredient | Weight percent | Grams per batch |
|---|---|---|
| Sucrose, granulated | 4.07 | 81.46 |
| Glycerin | 2.32 | 46.39 |
| Water | | 1337.66 |

The sodium hydroxide is dissolved in the water, and gum arabic is added to the solution and mixed until uniform. The glycerin, sodium chloride, sorbitol, and sucrose are added to the mixture with constant stirring. Separately, the dry ingredients are combined and this combination is added to the mixture and mixed to provide a uniform blend.

The blended material is transferred into a Groen kettle and heated to between 43.3° C. and 46.1° C., while slowly being mixed and the material is maintained within this temperature range for another 30 minutes. The material is removed from the kettle and placed into a depositor, with the temperature of the mixture maintained at about 43.3° C. during this time. Slurry portions are deposited into preformed shapes within a starch mold or bed, and dried at 54.4° C. at 15% relative humidity for about 19 hours. The resulting pastilles are removed from the mold when the moisture level of the pastilles is between about 15% and about 17%.

Example 3: Pastille B (RuBisCO as Binder)

Dry Blend:

| Ingredient | Weight percent | Grams per batch |
|---|---|---|
| Milled tobacco (<60 μm) | 28.29 (90% solids) | 628.67 |
| Tobacco extract (spray dried) | 4.58 (90% solids) | 101.78 |
| Sucralose | 1.04 (99% solids) | 21.10 |
| Flavorant | 4.23 (95% solids) | 89.34 |

Wet Blend:

| Ingredient | Weight percent | Grams per batch |
|---|---|---|
| Sodium hydroxide | 0.20 | 4.00 |
| Gum Arabic | 17.37 (90% solids) | 386.0 |
| Tobacco-derived RuBisCO Powder | 12.00 (90% solids) | 266.67 |
| Sorbitol liquid | 23.53 (70% solids) | 672.29 |
| Sodium chloride | 2.36 | 47.32 |
| Sucrose, granulated | 4.07 | 81.46 |
| Glycerin | 2.32 | 46.39 |
| Water | | 1515.73 |

The sodium hydroxide is dissolved in the water, and gum arabic and RuBisCO are added to the solution and mixed until uniform. The glycerin, sodium chloride, sorbitol, and sucrose are added to the mixture with constant stirring. Separately, the dry ingredients are combined and this combination is added to the mixture and mixed to provide a uniform blend.

The blended material is transferred into a Groen kettle and heated to between 43.3° C. and 46.1° C., while slowly being mixed and the material is maintained within this temperature range for another 30 minutes. The material is removed from the kettle and placed into a depositor, with the temperature of the mixture maintained at about 43.3° C. during this time. Slurry portions are deposited into preformed shapes within a starch mold or bed, and dried at 54.4° C. at 15% relative humidity for about 19 hours. The resulting pastilles are removed from the mold when the moisture level of the pastilles is between about 15% and about 17%.

Example 4: Chewy Gel a (RuBisCO as Filler)

Dry Blend:

| Ingredient | Weight percent | Grams per batch |
|---|---|---|
| Tobacco-derived RuBisCO Powder | 18 | 1224.7 |
| Tobacco extract concentrate | 18 (76.5% solids) | 1224.7 |
| Sucralose | 0.5 | 34.0 |
| Sodium chloride | 5 | 340.2 |
| Sodium carbonate | 1.2 | 81.6 |
| Citric acid | 1 | 68.0 |
| Menthol crystals | 0.3 | 20.4 |

Master Batch (Binder):

| Ingredient | Weight percent | Grams per batch |
|---|---|---|
| Hydroxypropyl cellulose (Klucel EF) | 5 | 340.2 |
| Gum arabic | 9 | 612.4 |
| Pullulan | 5 | 340.2 |
| Propylene glycol | 2.5 | 170.1 |
| Flavorant | 0.5 | 34.0 |

Wet Blend:

| Ingredient | Weight percent | Grams per batch |
|---|---|---|
| Sorbitol liquid | 12 (70% solids) | 1166.4 |
| Erythritol | 10 | 680.4 |
| Isomalt | 12 | 816.5 |
| Water | | 622.1 |

The propylene glycol and flavorant are mixed and the remaining master batch ingredients are combined in a mixer and mixed for 3-5 minutes at medium speed. The dry blend ingredients are separately combined and the master batch mixture is added to the dry blend ingredients. The mixture is mixed for 15 minutes and transferred to a gravimetric feeding hopper.

Separately, water, sorbitol solution, erythritol, and isomalt crystals are mixed in a stainless steel vessel. The mixture is heated to a temperature of about 120° C. to 125° C. and is held at that temperature while mixing until all crystals melt or dissolve completely. The temperature is held for another 10 minutes at this temperature with gentle mixing and then maintained at a temperature of at least 80° C. to 90° C. until transferred to an extruder.

The master and dry blend mixtures are metered into a twin screw extruder and the combination is extruded through an oval aperture die opening to give a cylindrical extrudate. The cylindrical extrudate is transferred onto perforated trays and dried at 22-25° C. at 30% relative humidity for about 30 minutes. The extrudate is then cut into smaller, rectangular or cylindrical pieces and aged for 3-5 days at 25° C. at 30% relative humidity.

Example 5: Chewy Gel B (RuBisCO as Filler)

Dry Blend:

| Ingredient | Weight percent | Grams per batch |
|---|---|---|
| Tobacco-derived RuBisCO Powder | 18 | 1224.7 |
| Tobacco extract concentrate | 18 (76.5% solids) | 1224.7 |
| Sucralose | 0.5 | 34.0 |
| Sodium chloride | 5 | 340.2 |
| Sodium carbonate | 1 | 68.0 |
| Citric acid | 1 | 68.0 |
| Menthol crystals | 0.3 | 20.4 |

Master Batch (Binder):

| Ingredient | Weight percent | Grams per batch |
|---|---|---|
| Carboxymethyl cellulose | 5 | 340.2 |
| Gum arabic | 9 | 612.4 |
| Maltodextrin | 6 | 408.2 |
| Propylene glycol | 2.5 | 170.1 |
| Flavorant | 0.7 | 47.6 |

Wet Blend:

| Ingredient | Weight percent | Grams per batch |
|---|---|---|
| Maltitol syrup | 12 (70% solids) | 1166.4 |
| Erythritol | 10 | 680.4 |
| Isomalt | 12 | 816.5 |
| Water | | 622.1 |

The propylene glycol and flavorant are mixed and the remaining master batch ingredients are combined in a mixer and mixed for 3-5 minutes at medium speed. The dry blend ingredients are separately combined and the master batch mixture is added to the dry blend ingredients. The mixture is mixed for 15 minutes and transferred to a gravimetric feeding hopper.

Separately, water, maltitol syrup, erythritol, and isomalt are mixed in a stainless steel vessel. The mixture is heated to a temperature of about 120° C. to 125° C. and is held at that temperature while mixing until all crystals melt or dissolve completely. The temperature is held for another 10 minutes at this temperature with gentle mixing and then maintained at a temperature of at least 80° C. to 90° C. until transferred to an extruder.

The master and dry blend mixtures are metered into a twin screw extruder and the combination is extruded through an oval aperture die opening to give a cylindrical extrudate. The cylindrical extrudate is transferred onto perforated trays and dried at 22-25° C. at 30% relative humidity for about 30 minutes. The extrudate is then cut into smaller, rectangular or cylindrical pieces and aged for 3-5 days at 25° C. at 30% relative humidity.

Example 6: Chewy Gel C (RuBisCO as Filler and Binder)

Dry Blend:

| Ingredient | Weight percent | Grams per batch |
|---|---|---|
| Tobacco-derived RuBisCO Powder | 18 | 1224.7 |
| Tobacco extract concentrate | 18 (76.5% solids) | 1224.7 |
| Sucralose | 0.5 | 34.0 |
| Sodium chloride | 5 | 340.2 |
| Sodium carbonate | 1.2 | 81.6 |
| Citric acid | 1 | 68.0 |
| Menthol crystals | 0.3 | 20.4 |

Master Batch (Binder):

| Ingredient | Weight percent | Grams per batch |
|---|---|---|
| HPC (Klucel EF) | 5 | 340.2 |
| Gum arabic | 9 | 612.4 |
| Tobacco-derived RuBisCO Powder | 10 | 680.4 |
| Propylene glycol | 2.5 | 170.1 |
| Flavorant | 0.5 | 34.0 |

Wet Blend:

| Ingredient | Weight percent | Grams per batch |
|---|---|---|
| Sorbitol liquid | 12 (70% solids) | 1166.4 |
| Erythritol | 10 | 680.4 |
| Isomalt | 12 | 816.5 |
| Water | | 5699.5 |

The propylene glycol and flavorant are mixed and the remaining master batch ingredients are combined in a mixer and mixed for 3-5 minutes at medium speed. The dry blend ingredients are separately combined and the master batch is added to the dry blend. The mixture is mixed for 15 minutes and transferred to a gravimetric feeding hopper.

Separately, water, sorbitol solution, erythritol, and isomalt crystals are mixed in a stainless steel vessel. The mixture is heated to a temperature of about 120° C. to 125° C. and is held at that temperature while mixing until all crystals melt or dissolve completely. The temperature is held for another 10 minutes at this temperature with gentle mixing and then maintained at a temperature of at least 80° C. to 90° C. until transferred to an extruder.

The master and dry blend mixtures are metered into a twin screw extruder and the combination is extruded through an oval aperture die opening to give a cylindrical extrudate. The cylindrical extrudate is transferred onto perforated trays and dried at 22-25° C. at 30% relative humidity for about 30 minutes. The extrudate is then cut into smaller, rectangular or cylindrical pieces and aged for 3-5 days at 25° C. at 30% relative humidity.

Example 7: Chewy Gel D (RuBisCO as Filler and Binder)

Dry Blend:

| Ingredient | Weight percent | Grams per batch |
|---|---|---|
| Tobacco-derived RuBisCO Powder | 13 | 884.5 |
| Tobacco extract concentrate | 18 (76.5% solids) | 1600.9 |
| Sucralose | 0.5 | 34.0 |
| Sodium chloride | 5 | 340.2 |
| Sodium carbonate | 1 | 68.0 |
| Cinnamyl aldehyde | 0.3 | 20.4 |

Master Batch (Binder):

| Ingredient | Weight percent | Grams per batch |
|---|---|---|
| CMC 15F | 5 | 340.2 |
| Gum arabic | 9 | 612.4 |
| Tobacco-derived RuBisCO Powder | 11 | 748.4 |
| Propylene glycol | 2.5 | 170.1 |
| Flavorant | 0.7 | 47.6 |

Wet Blend:

| Ingredient | Weight percent | Grams per batch |
|---|---|---|
| Maltitol syrup | 12 (70% solids) | 1166.4 |
| Erythritol | 10 | 680.4 |
| Isomalt | 12 | 816.5 |
| Water | | 8096.9 |

The propylene glycol and flavorant are mixed and the remaining master batch ingredients are combined in a mixer and mixed for 3-5 minutes at medium speed. The dry blend ingredients are separately combined and the master batch mixture is added to the dry blend ingredients. The mixture is mixed for 15 minutes and transferred to a gravimetric feeding hopper.

Separately, water, sorbitol solution, erythritol, and isomalt crystals are mixed in a stainless steel vessel. The mixture is heated to a temperature of about 120° C. to 125° C. and is held at that temperature while mixing until all crystals melt or dissolve completely. The temperature is held for another 10 minutes at this temperature with gentle mixing and then maintained at a temperature of at least 80° C. to 90° C. until transferred to an extruder.

The master and dry blend mixtures are metered into a twin screw extruder and the combination is extruded through an oval aperture die opening to give a cylindrical extrudate. The cylindrical extrudate is transferred onto perforated trays and dried at 22-25° C. at 30% relative humidity for about 30 minutes. The extrudate is then cut into smaller, rectangular or cylindrical pieces and aged for 3-5 days at 25° C. at 30% relative humidity.

Generally, the inclusion of RuBisCO (e.g., as a binder and/or as a filler) in various types of products provides at least some degree of the desired effects (e.g., binding and/or filling). RuBisCO generally provides properties comparable to traditional binders or fillers, depending how it is incorporated within the product. Accordingly, the tobacco-derived RuBisCO disclosed herein can function as a replacement or substitute for traditional binders or fillers in various products.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A protein-enriched smokeless tobacco product comprising:

a tobacco material;

a protein-enriched, tobacco-derived material in an amount of at least about 2 percent by dry weight; and one or more sugar alcohols in an amount of at least about 10 percent by dry weight, wherein the protein-enriched, tobacco-derived material comprises at least about 60 percent tobacco-derived protein by dry weight, wherein the product is chewable, and wherein the product is a single layer product comprising a mixture of the tobacco material, the protein-enriched tobacco-derived material, and the one or more sugar alcohols.

2. The protein-enriched smokeless tobacco product of claim 1, wherein the protein-enriched, tobacco-derived material comprises at least about 80 percent tobacco-derived protein by dry weight.

3. The protein-enriched smokeless tobacco product of claim 2, wherein at least about 50 percent of the tobacco-derived protein by dry weight is RuBisCO.

4. The protein-enriched smokeless tobacco product of claim 2, wherein at least about 80 percent of the tobacco-derived protein by dry weight is RuBisCO.

5. The protein-enriched smokeless tobacco product of claim 2, wherein at least about 50 percent of the tobacco-derived protein by dry weight is F2 proteins.

6. The protein-enriched smokeless tobacco product of claim 1, wherein the tobacco material comprises particulate tobacco.

7. The protein-enriched smokeless tobacco product of claim 6, wherein the particulate tobacco comprises a mixture of flue-cured and sun-cured tobacco.

8. The protein-enriched smokeless tobacco product of claim 6, wherein the particulate tobacco is present in an amount of at least about 10 percent by dry weight.

9. The protein-enriched smokeless tobacco product of claim 1, wherein the tobacco material comprises a tobacco extract.

10. The protein-enriched smokeless tobacco product of claim 1, wherein the one or more sugar alcohols are selected from the group consisting of erythritol, arabitol, ribitol, isomalt, maltitol, dulcitol, iditol, mannitol, xylitol, lactitol, sorbitol, and combinations thereof.

11. The protein-enriched smokeless tobacco product of claim 1, further comprising a natural gum binder in an amount of between about 2 percent and about 10 percent by dry weight.

12. The protein-enriched smokeless tobacco composition of claim 11, wherein the natural gum binder component is selected from the group consisting of gum arabic, xanthan gum, guar gum, ghatti gum, gum tragacanth, karaya gum, locust bean gum, gellan gum, and combinations thereof.

13. The protein-enriched smokeless tobacco product of claim 1, further comprising a binder in an amount of between about 5 percent and about 20 percent by dry weight.

14. The protein-enriched smokeless tobacco product of claim 13, wherein the binder comprises pregelatinized rice starch.

15. The protein-enriched smokeless tobacco product of claim 1, further comprising one or more fillers in an amount of between about 5 percent and about 20 percent by dry weight.

16. The protein-enriched smokeless tobacco product of claim 15, wherein the one or more fillers comprise a polysaccharide filler, a starch filler, or a combination thereof.

17. The protein-enriched smokeless tobacco product of claim 15, wherein the one or more fillers are selected from the group consisting of rice flour, maltodextrin, calcium carbonate, and combinations thereof.

18. The protein-enriched smokeless tobacco product of claim 1, further comprising an additive selected from the group consisting of flavorants, sweeteners, emulsifiers, disintegration aids, humectants, buffering agents, salts, and combinations thereof.

19. The protein-enriched smokeless tobacco product of claim 1, wherein the composition further comprises glycerin.

20. The protein-enriched smokeless tobacco product of claim 1, comprising:

at least about 20 dry weight percent of the tobacco material, wherein the tobacco material comprises particulate tobacco;

and between about 5 percent and about 20 dry weight percent of a filler, wherein the filler comprises a combination of a polysaccharide filler and a starch filler, and wherein the tobacco-derived protein comprises at least about 80% by dry weight RuBisCO.

21. The protein-enriched smokeless tobacco product of claim 1, comprising:

at least about 20 dry weight percent of the tobacco material, wherein the tobacco material comprises particulate tobacco;

at least about 2 dry weight percent of a natural gum binder; and at least about 10 dry weight percent of a binder other than a natural gum binder, wherein the tobacco-derived protein comprises at least about 80% by dry weight RuBisCO.

22. The protein-enriched smokeless tobacco product of claim 1, comprising:

at least about 20 dry weight percent of the tobacco material, wherein the tobacco material comprises particulate tobacco; and between about 5 percent and about 20 percent by dry weight of a filler, wherein the filler comprises a combination of a polysaccharide filler and a starch filler, at least about 2 dry weight percent of a natural gum binder; and at least about 10 dry weight percent of a binder other than a natural gum binder, wherein the tobacco-derived protein comprises at least about 80% by dry weight RuBisCO.

23. A method of preparing a protein-enriched smokeless tobacco product, comprising:

combining a dry mixture comprising a tobacco material, a protein-enriched, tobacco-derived material; and one or more sugar alcohols, wherein the protein-enriched, tobacco-derived material comprises at least about 60 percent tobacco-derived protein by dry weight, with a wet mixture comprising salt and flavorants to give a combined mixture; and extruding the combined mixture to give a protein-enriched smokeless tobacco product comprising the protein-enriched, tobacco-derived material in an amount of at least about 2 percent by dry weight and the one or more sugar alcohols in an amount of at least about 10 percent by dry weight, wherein the product is chewable, and wherein the product is a single layer product comprising a mixture of the tobacco material, the protein-enriched, tobacco-derived material, and the one or more sugar alcohols.

* * * * *